US005577808A

United States Patent [19]

Gilbert

[11] Patent Number: 5,577,808

[45] Date of Patent: Nov. 26, 1996

[54] QUARRY MINER

[75] Inventor: Jerry F. Gilbert, Southlake, Tex.

[73] Assignee: Trencor, Inc., Grapevine, Tex.

[21] Appl. No.: 414,680

[22] Filed: Apr. 3, 1995

[51] Int. Cl.[6] ..... E01C 23/12

[52] U.S. Cl. ..... 299/39.2; 404/90

[58] Field of Search ..... 299/15, 39.2, 39.4, 299/39.5, 39.6, 39.8, 39.9; 404/90

[56] References Cited

U.S. PATENT DOCUMENTS

| | | | |
|---|---|---|---|
| 1,210,453 | 1/1917 | French . | |
| 4,637,753 | 1/1987 | Swisher, Jr. | 299/39.2 X |
| 4,723,867 | 2/1988 | Wirtgen | 299/39.2 X |
| 4,755,001 | 7/1988 | Gilbert | 299/39 |
| 5,092,657 | 3/1992 | Bryan, Jr. | 299/1.1 |
| 5,228,220 | 7/1993 | Bryan, Jr. | 37/364 |

*Primary Examiner*—William P. Neuder
*Attorney, Agent, or Firm*—Ross, Clapp, Korn & Montgomery, L.L.P.

[57] ABSTRACT

A ground supported vehicle for excavating the ground is extremely large and must be dismantled into several sections in order to transport it down a roadway or a railway. The vehicle has a mid-section that is located between opposed ends. A digging apparatus wider than the vehicle is attached within a lower part of the vehicle mid-section, and can bear the entire weight of the vehicle in order to apply an unusually heavy load onto the digging apparatus. The digging apparatus is rotatable mounted on a massive shaft that is anchored at the center of gravity of the vehicle. Digging teeth are arranged on the outside surface of the digging apparatus so that the teeth dig into and excavates the ground when moved against the ground while rotating. A diesel motor is connected by a special power train for providing the tremendous power requirements of the rotating shaft of the digging apparatus, while a smaller motor provides the power for operating the conveyors, for raising and lowering the digging apparatus; and for propelling the vehicle along the ground. An elongated boom has a pivoted end mounted on a special gooseneck that extends from one end of the vehicle. A boom conveyor is mounted on the boom. The other end of the boom can be raised or lowered as well as swung in a segment of a circle to discharge material far away from the boom pivot. An internal conveyor is mounted for vertical movement within the mid-section, and delivers material into the boom conveyor. There is a mold board mounted for vertical movement at a location between the feed end of the internal conveyor and the digging apparatus, all of which cooperates together to translocate excavated material onto the conveyor system.

18 Claims, 12 Drawing Sheets

QUARRY MINER

BACKGROUND OF THE INVENTION

The present invention is useful in excavating hard rocky formations such as encountered in the building of highways and in the operation of a quarry or a mine, and wherever the removal of a large overburden of material is necessary in order to gain possession of the underlying minerals or paydirt.

This invention is especially useful for the removal of a layer of earth or rock that is hundreds of acres in area and more than 100 foot thick, for example. The economics of such a monumental task requires specially designed digging equipment of a tremendous size that usually is assembled at the mine where it remains during its entire life. This is because a ground supported vehicle that can more efficiently dig through and excavate great quantities of rock is too large and too heavy to be transported down a roadway or a railway. Therefore, should it become necessary or desirable to move such a large digging machine, it must first be dismantled into several sections in order to reduce the machine into smaller packages, each being of a manageable size and weight, to thereby facilitate changing job sites.

By the present invention it has been found advantageous to provide such a digging machine with a mid-section located at the longitudinal center of gravity and between opposed ends thereof, with there being a digging apparatus having a mining drum that is wider than the vehicle and is attached at the lower part of the vehicle mid-section to assure that the entire machine can traverse a deep cut as it is being formed, and also to dig immediately adjacent any structure. Additionally, provision is made by which the digging apparatus of such a vehicle can be extended against the ground with a force that is equal to the entire weight of the vehicle, and thereby apply an unusually large load onto the digging teeth of the digging apparatus as it digs into and excavates the ground. Gigantic supercharged diesel engines are available that can supply the enormous amount of power required for rotating such a huge digging apparatus under these unusual excavating conditions.

Heretofore, some extremely large excavating machines, that is, those weighing near 200 tons, have employed endless digging apparatus having digging teeth of various design mounted thereon, with the digging apparatus being indirectly mounted to the vehicle main frame in a manner to enable movement thereof respective to the main frame of the vehicle in order to adjust the drive chain tension thereof, and to adjust the depth of penetration of the digging apparatus respective to the ground. It has been discovered that when the digging teeth of these large prior art excavating machines are forced against the hard or rocky ground with sufficient power input and speed to achieve a good rate of penetration, undesirable vibration and chattering of the digging apparatus, including the digging teeth and the drive train, results from the interaction of the digging teeth with the hard formation as the teeth engage and excavate the formation or earth. This described action induces harmonic motion into the structure which oscillates at frequencies which breaks the teeth and unduly accelerates wear of the drive train, thereby requiring excessive maintance. Accordingly, heretofore it has not been possible to increase the load on the teeth of the digging apparatus while concurrently increasing the power input thereto in the manner taught herein.

By the present invention, there is provided a quarry miner or digging machine having a digging apparatus that includes a mining drum rotatably received on a shaft. The shaft is directly mounted to the vehicle main frame in order to reduce vibratory motion to a minimum. The mining drum is driven by an endless ladder type excavating apparatus that also forms part of the mining drum as well as the drive chain therefor. This arrangement allows the rotating ground engaging parts thereof to be rigidly mounted respective to the main frame of the vehicle. It has been discovered that this novel arrangement of the digging apparatus of a large excavating machine minimizes the vibrational problems cited above and consequently the digging teeth thereof can be forced against the hard or rocky ground with sufficient force to acheive an unexpected improvement in the rate of penetration. Reducing the maintance by reducing these undesirable vibrational forces along with reducing the induced chattering of the components of the digging apparatus allows an unexpected increased application of weight and power to the digging apparatus to be gained, whereby increased penetration rate, increased depth of the cut, and reduced wear on the digging apparatus and the drive train is realized.

Accordingly, by the present invention it is possible to increase the load on the digging teeth of the digging apparatus while concurrently increasing the power input thereto in a manner not heretofore possible.

Further, the present invention teaches improvements in translocating the excavated material from the ground onto a special conveyor system by the employment of a mold board in combination with the improved digging apparatus and a novel conveyor system therefor. The improved conveyor system translocates the excavated material from the centrally located digging apparatus to an unusually long conveyor system that can be raised or lowered, as well as swung in an arc, so as to reach out and discharge material far away from the digging apparatus. This enables the excavated material to be redeposited in the mined out area, and most important of all, to load the paydirt into appropriate conveyance means by which the paydirt can be translocated to a suitable processing facility.

Apparatus that overcomes the foregoing problems and achieves these and other desirable goals is the subject of this invention.

SUMMARY OF THE INVENTION

This specification sets forth the precise invention for which a patent is solicited, in such manner as to distinguish it from other inventions and from what is old. This invention broadly comprehends a quarry miner, or excavating machine, comprising a vehicle having ground engaging support means by which the vehicle is elevated into a horizontal position, or maintained in any desired plane respective to the horizontal. A prime mover is supported on the vehicle for providing power means to an excavating apparatus and by which the vehicle is propelled along the ground, as well as the power means for operating other power consuming apparatus thereof.

The excavating machine has opposed sides, a top opposed to a bottom, a mid-section between opposed ends; and, the digging apparatus is in the form of a combination mining drum and ladder type digging apparatus. The mining drum is rotatably attached to the vehicle mid-section in underlying relationship thereto. The mining drum is mounted for rotation about the longitudinal axis of a large shaft which is anchored to the vehicle main frame at the center of gravity thereof. The mining drum is comprised of three axially aligned cylindrical sections that include a center section in the form of an endless ladder type digging apparatus, with there being opposed cylindrical digging drums affixed to the opposed ends of the center section and rotatably mounted respective to the large shaft. Digging teeth are arranged in a special pattern and are attached to the outer peripheral surface of the mining drum, and are moved against the ground to thereby excavate material therefrom.

The direct mounting of the large shaft to the main frame reduces viberation loads imparted into the digging teeth and power train to a minimum and thereby allows increased tooth speed and load to be imposed on the digging teeth, which greatly improves the efficiency of operation of the quarry miner. The endless ladder type digging apparatus is interconnected with the power means by the provision of a special split power train, made in accordance with this invention. Part of the power train that moves the endless ladder can be adjusted such that the tension in the endless ladder of the digging apparatus can be suitably adjusted while thereby avoiding changes in the mounted shaft therefor.

The power means, in addition to propelling the vehicle, also operates the conveyors, powers the digging apparatus, and positions the main frame and thus the mining drum respective to the ground. Further, there is a mold board adjacent the mining drum having a forward face that cooperates with the mining drum to provide a passageway along which the excavated material is moved from the ground and up onto a centrally located longitudinally extending conveyor system. The mold board can have a blade located at the lower end thereof for smoothing the surface of the cut.

A boom extends from a lower trailing end of the quarry miner, and has a pivoted end opposed to a far end. The boom supports a boom conveyor thereon having a discharge end opposed to a feed end. A pylon attached near to the upper trailing end of the quarry miner provides a mount for an extensible means by which the far end of the boom is elevated. A goose neck pivot underlies the pylon and provides the boom pivot about which the far end of the boom is pivotally moved and also raised and lowered.

The centrally located conveyor system is contained within the vehicle and has a feed end fixedly mounted respective to the main frame and movably mounted respective to the mold board, and a discharge end positioned to deliver excavated material onto the feed end of the boom conveyor. The mold board is mounted for vertical adjustment at a location between the feed end of the internal conveyor and the underside of the centersection of the mining drum whereby accumulated excavated material is forced to move up the intervening space between the mold board and the mining drum to thereby translocate excavated material from the ground onto the feed end of the internal conveyor.

The quarry miner preferably is supported on a plurality of endless tracks that are spaced apart and located fore and aft of the mid-section. Support struts reciprocatingly mount the quarry miner respective to the tracks for independently elevating each quadrant of the quarry miner respective to the ground and thereby select the optimum weight imposed on the digging teeth as well as selecting the optimum relative position of the mining drum respective to the ground. The struts located at one end of the quarry miner form a steering system and are mounted for rotation about a vertical axis for turning the endless tracks and thereby steering the quarry miner as it moves along the ground.

A primary object of the present invention is the provision of an excavating machine, or quarry miner, comprising a vehicle having ground engaging support means by which said vehicle is elevated into a plane that is parallel to an excavation that is being formed; and, a digging apparatus is attached to the vehicle mid-section in underlying relationship thereto, so that the entire weight of the machine can be imposed on the digging apparatus thereof.

Another object of this invention is to provide an excavating machine having a mid-section located near the center of gravity thereof within which a digging apparatus having a mining drum is mounted. The mining drum is mounted for rotation about the longitudinal axis of a large shaft which is anchored to the vehicle main frame at the center of gravity thereof. A boom is pivotally attached to and extends from one end of the vehicle, and supports a conveyor thereon having a discharge end opposed to a feed end. A pylon is attached to an upper end of the vehicle and includes means for elevating the far end of the boom as the far end pivots about the boom pivot. A mold board cooperates with the digging apparatus to feed excavated material onto the feed end of an internal conveyor. The mold board is positioned for vertical movement at a location between the feed end of the internal conveyor and the digging apparatus.

A further object of this invention is to disclose and provide a digging machine that can be dismantled into a plurality of sections, including a mid-section, that are removably fastened together. A boom conveyor is arranged for pivotal movement at one end of the vehicle; and, a digging apparatus is attached to the vehicle mid-section. An internal conveyor means has a feed end mounted adjacent to a mold board within the mid-section and a discharge end positioned to deliver material onto the feed end of the boom conveyor. The mold board is mounted for adjustment at a location between the feed end of the internal conveyor and the digging apparatus, and thereby provides the means by which excavated material is forced from the ground onto the feed end of the internal conveyor, and then onto the boom conveyor where it is discharged remotely from the quarry miner.

A still further object of this invention is to provide a vehicle having a digging apparatus attached to a mid-section thereof and in underlying relationship thereto and at the center of gravity thereof; a pivoted boom conveyor is supported at one end of the vehicle; and, an internal longitudinally extending conveyor has a feed end thereof mounted within said mid-section and a discharge end thereof is positioned to deliver material onto the feed end of the boom conveyor. The boom conveyor has a discharge end opposed to the feed end thereof. A pivoted gooseneck is positioned for supporting the feed end of the boom conveyor, and the boom thereof is supported for pivotal movement from a pylon located above the gooseneck. A power train operates the digging apparatus and the digging apparatus is rotatably anchored to the vehicle main frame and extends laterally beyond the vehicle sides whereby the vehicle can move through the path cut by the digging apparatus.

Still another and further object of this invention is to provide a vehicle having a digging apparatus, including a mining drum having a shaft therefor directly anchored to a mid-section thereof and in underlying relationship thereto and at the center of gravity of a main frame thereof; and, a power train operates the digging apparatus to rotate the mining drum thereof with a minimum of vibration. The mining drum extends laterally beyond the vehicle sides whereby the vehicle can move through the path cut by the digging apparatus and immediately adjacent any structure. The mining drum is comprised of three axially aligned cylindrical sections that include a center section in the form of an endless ladder type digging apparatus, with there being opposed cylindrical digging drums affixed to the opposed ends of the center section and extending beyond the sides of the vehicle. Digging teeth are arranged in a special pattern and are attached to the outer peripheral surface of the mining drum, and are moved against the ground to thereby excavate material therefrom.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
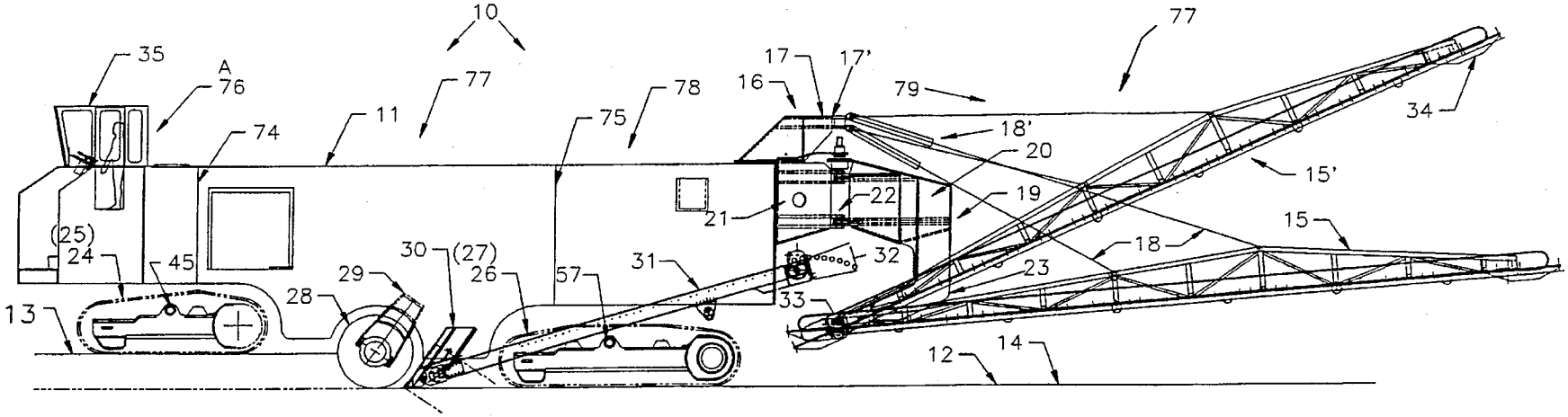
FIG. 1 is a side elevational view of a mining machine, made in accordance with this invention, with some additional parts thereof being shown in phantom to illustrate the operation thereof, and some parts thereof being broken away in order to disclose the interior thereof.
Figure 2:
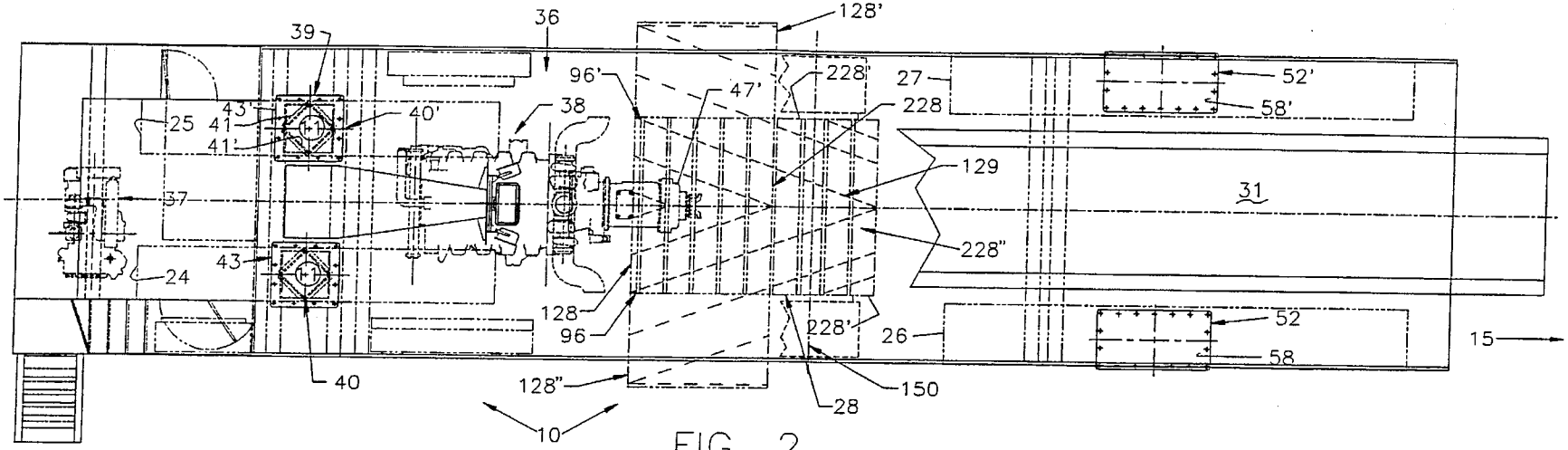
FIG. 2 is a top plan view of the mining machine of FIG. 1, with some parts being removed therefrom and some of the remaining parts thereof being shown in phantom to illustrate the location thereof.

The attached drawings illustrate schematically, and as an example, the preferred embodiment of a quarry miner, or excavating and mining machine 10, according to this invention. Referring to FIGS. 1 and 2, together with various other figures of the drawings, the excavating machine 10 comprises a ground supported vehicle having a mid-section 11 that travels along the illustrated surface of the ground 12 and, when in operation, changes the unmined surface 13 of the ground 12 into a leveled mined surface 14. The trailing end of the mining machine 10 supports a near end of a pivoted external boom conveyor 15 therefrom. A mid-portion of the boom conveyor 15 is raised and lowered by means of any suitable extensible apparatus connected between a boom conveyor support pylon 16 and the mid-portion of the boom conveyor 15.

Figure 3:
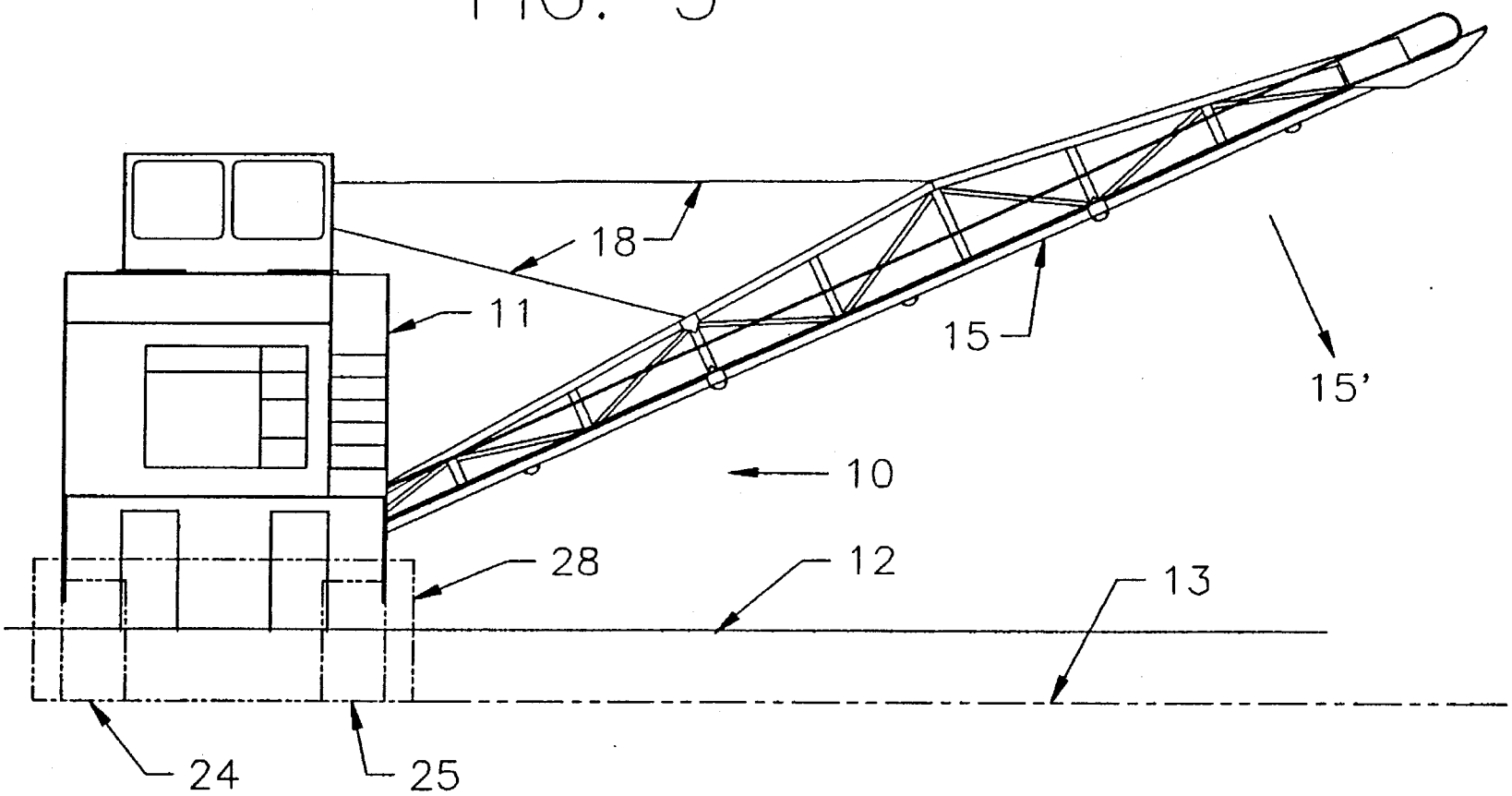
FIG. 3 is a front view of the mining machine of FIG. 1.
Figure 5:
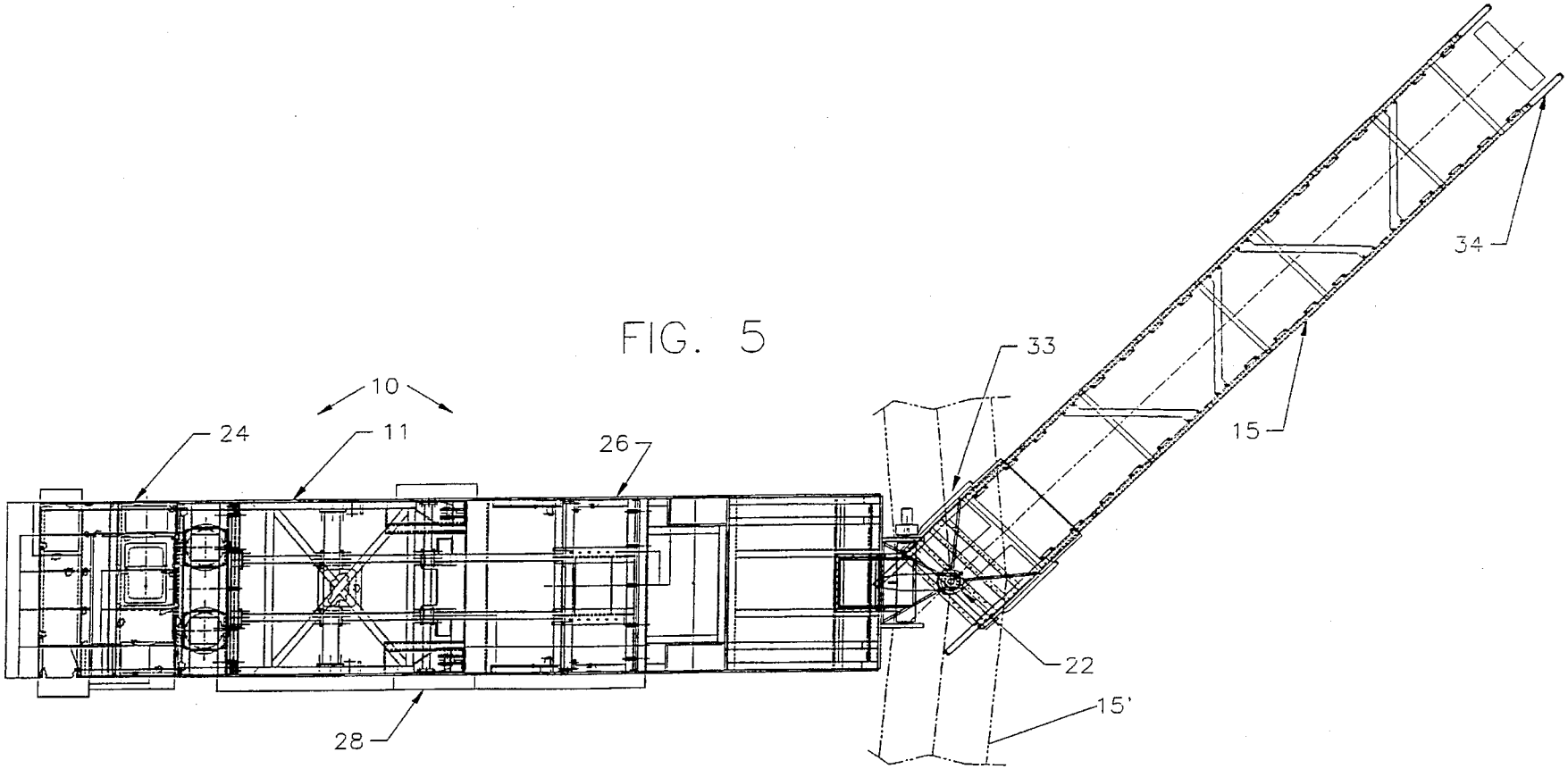
FIG. 5 is a reduced, top plan view of the mining machine of FIG. 1, with some additional parts thereof being shown in phantom to illustrate the operation thereof.

In FIGS. 1, 3, and 5, numeral 15' indicates movement of the boom conveyor 15 as it pivotally and vertically moves into any desired alternate position within an infinite range of positions, as will be more fully discussed later on herein.

In FIG. 1, together with FIG. 5 and other figures of the drawing, the conveyor support pylon assembly 16 has a near end that is attached to the upper trailing end of the mining machine 10, and includes a pivoted support member 17 that is removably attached to the pylon assembly 16. The pylon assembly 16 serves as an anchor device for pivotally supporting the illustrated cables 18 along with the tensioning or elevating means 18' that is hinged thereto for elevating the boom conveyor 15. The plurality of cables 18 are connected between a hinged member 17' and a medial portion of the boom conveyor 15. The cable ends are connected to a suitable tensioning device, such as the illustrated hydraulic cylinder and piston assembly 18', for selected adjustment of the length thereof so that the boom conveyor 15 is vertically raised and lowered by the reciprocating action of the hydraulic cylinder and piston assembly, which also pivotally moves respective to the quarry mining machine by means of the pivoted support member 17 and the hinged member 17' as it describes an arc or circle about the trailing end of the quarry mining machine 10. Where deemed desirable to do so, a cable drum or other similar apparatus can be used in lieu of the piston assembly 18' for lifting and lowering the boom conveyor, while remaining within the comprehension of this invention.

As seen in FIGS. 1, 10, 11 and 12, a goose neck boom conveyor support, generally indicated by the arrow at numeral 19, has a near end that is attached to and forms part of the superstructure seen at the trailing end of the dirt mining machine 10. The goose neck boom conveyor support 19 includes a pivoted conveyor support member 20 that is hingedly connected to a fixed goose neck conveyor support member 21 along a hinged or pivoted axis 22. The fixed goose neck conveyor support member 21 has an end opposed to the pivoted conveyor support member 20 that is rigidly attached to the trailing end of the dirt mining machine 10, as shown in FIG. 1.

Figure 6:
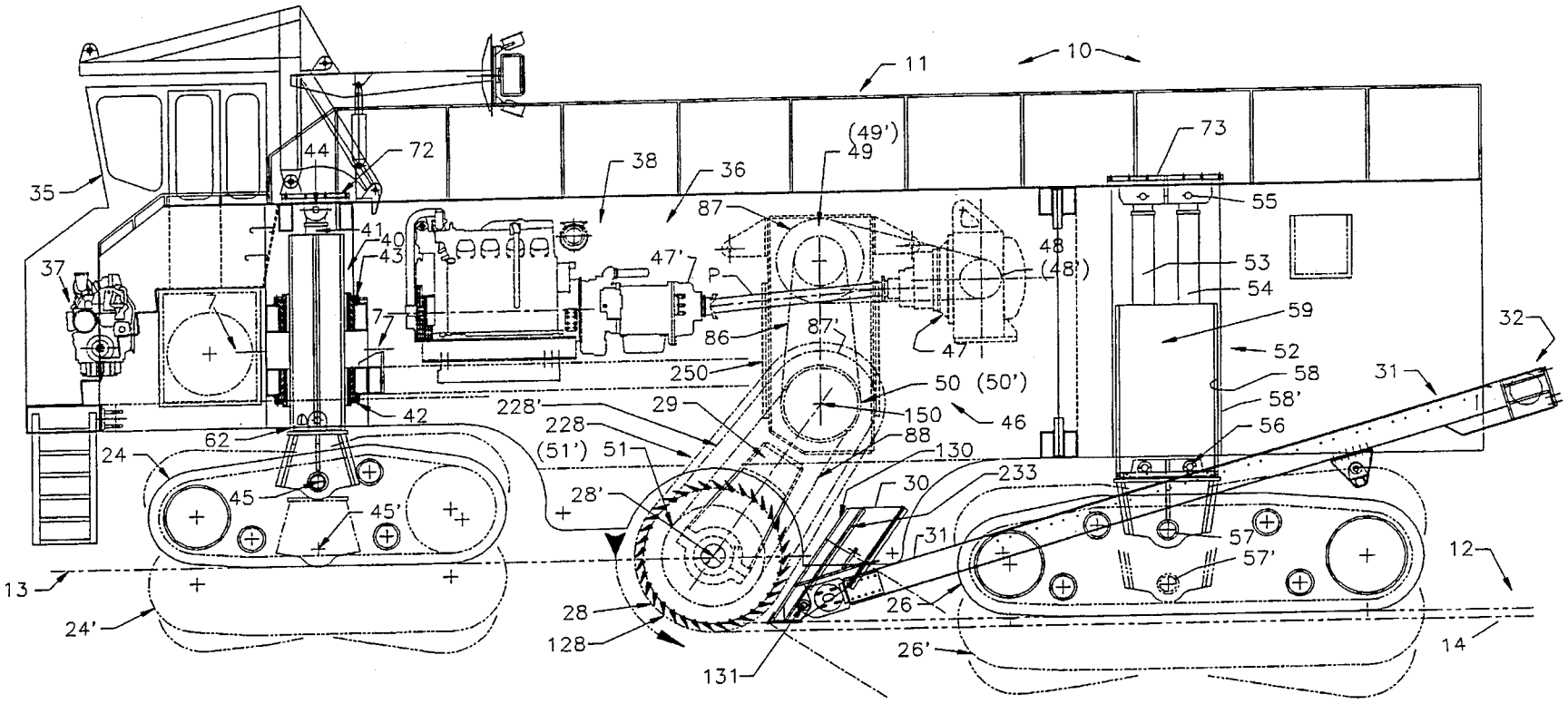
FIG. 6 is an enlarged, part cross-sectional side view of the mining machine of FIG. 1, with some parts thereof being removed therefrom to illustrate the interior thereof, and some other parts being shown in phantom to illustrate the operation thereof.
Figure 7:
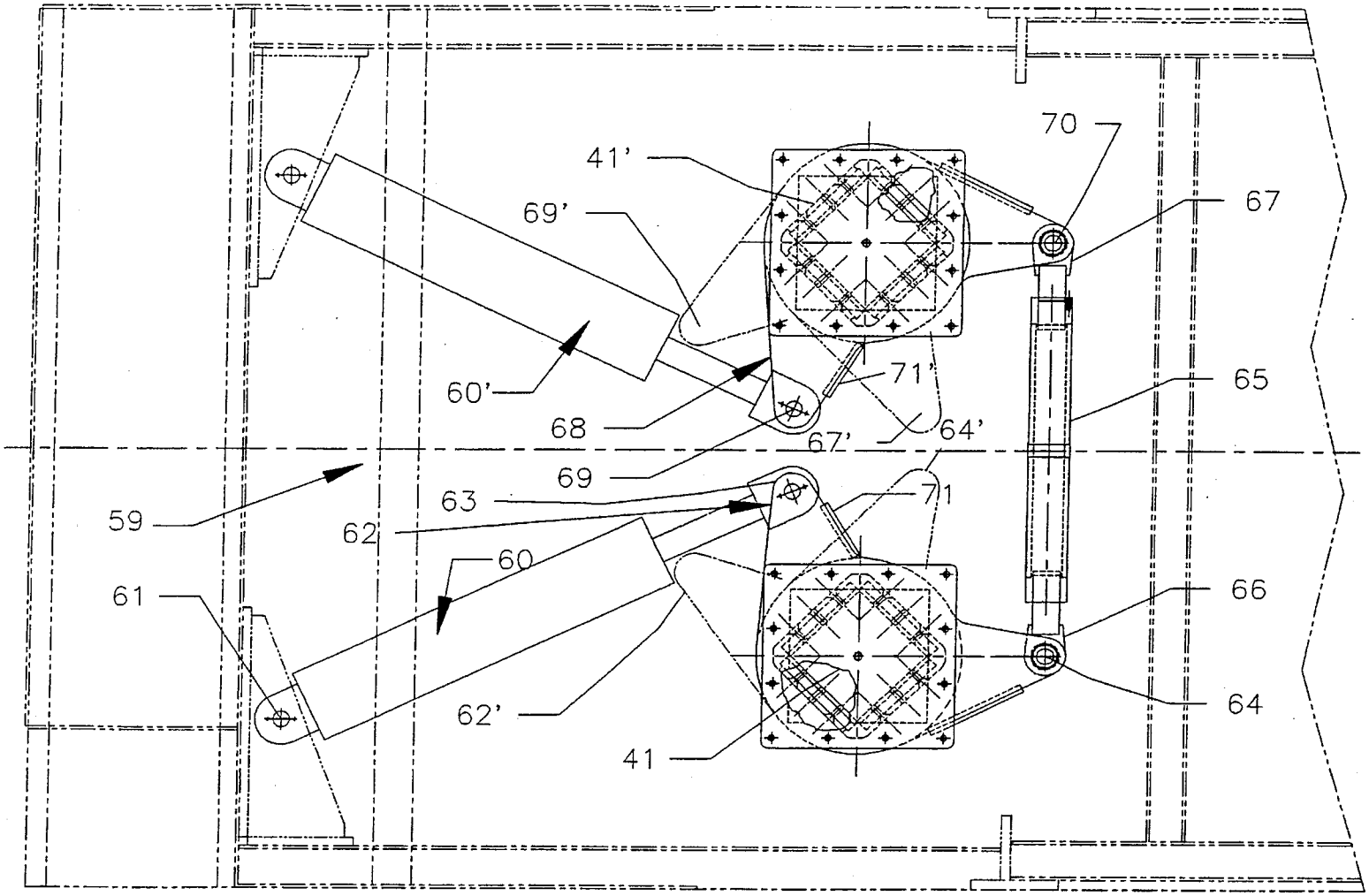
FIG. 7 is an enlarged, fragmentary, top plan view of the mining machine of FIG. 1, with some additional parts thereof being shown in phantom to illustrate the operation thereof.
Figure 8:
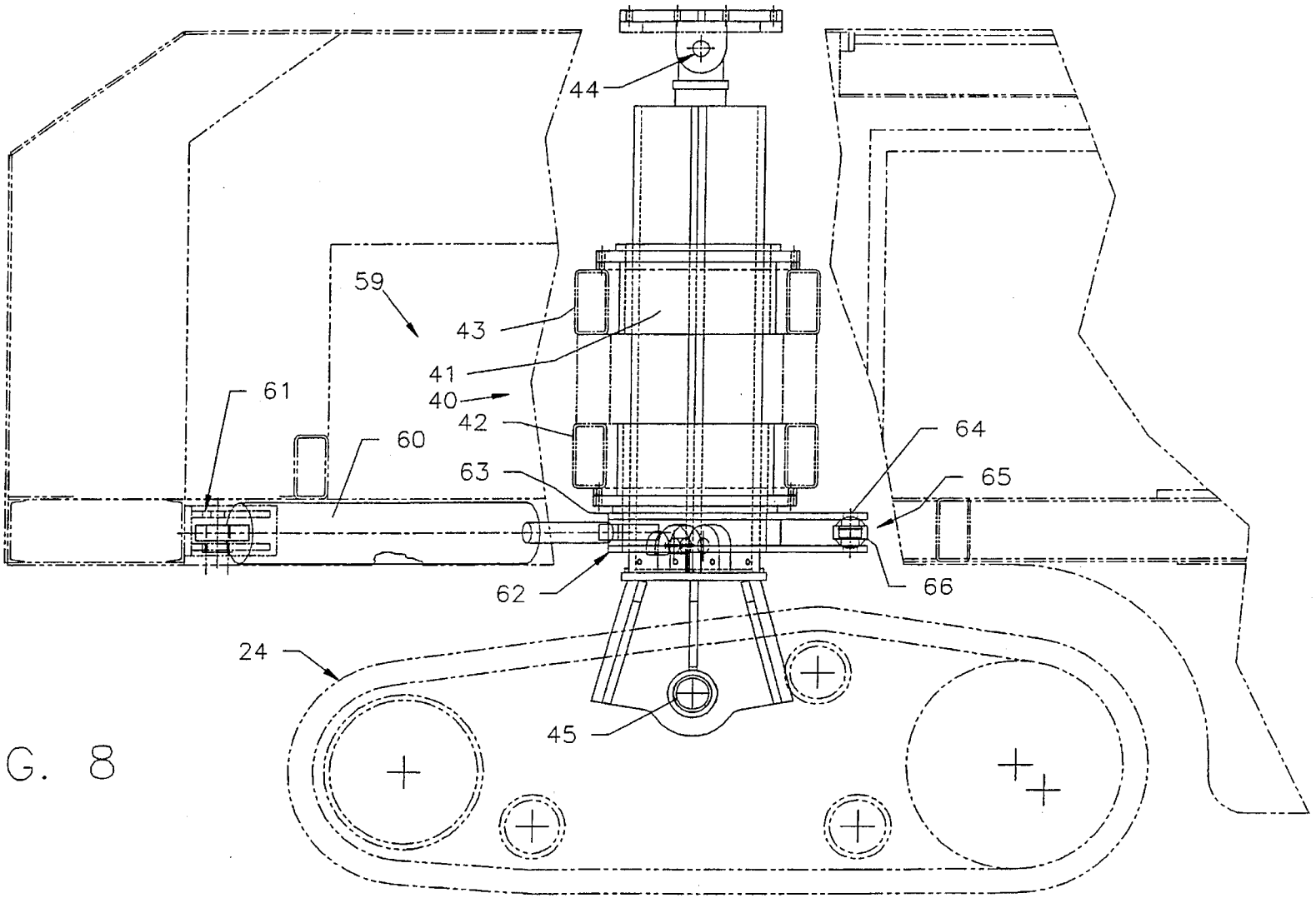
FIG. 8 is an enlarged, part cross-sectional, fragmentary side view showing additional details of part of the apparatus disclosed in some of the foregoing Figures.
Figure 9:
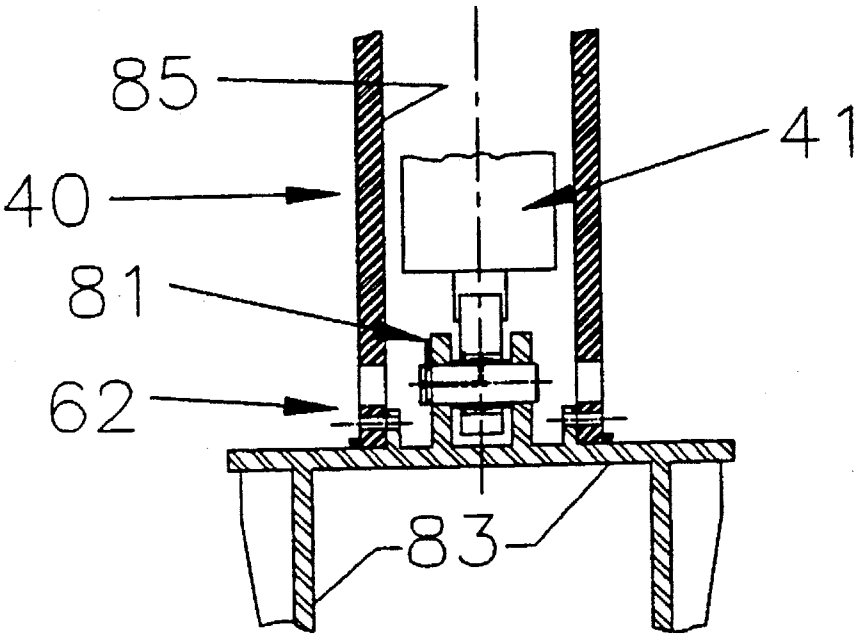
FIG. 9 is an enlarged, detailed, cross-sectional view taken along line 9—9 of FIG. 8.
Figure 10:
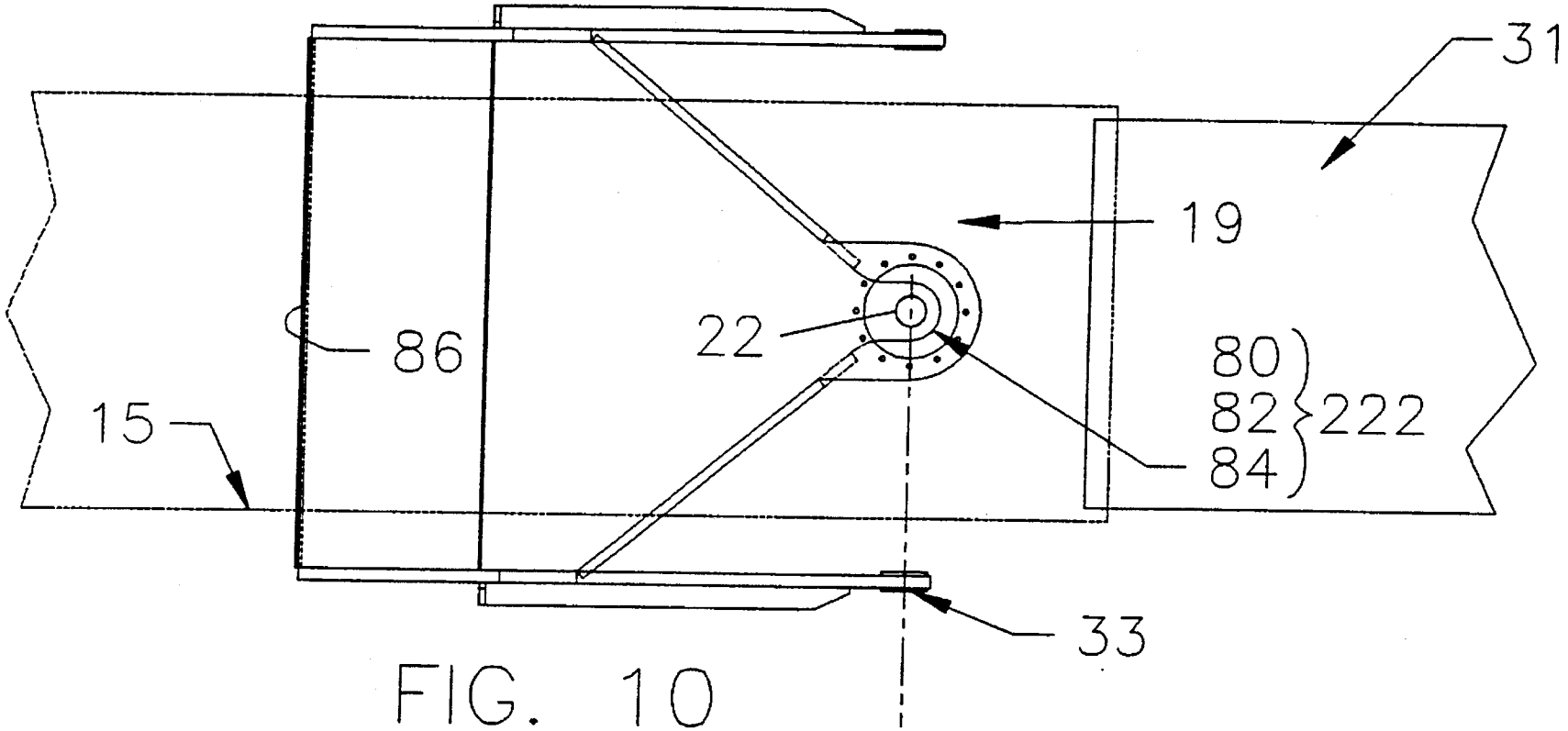
FIG. 10 is a top plan view of the apparatus of FIG. 11.
Figure 11:
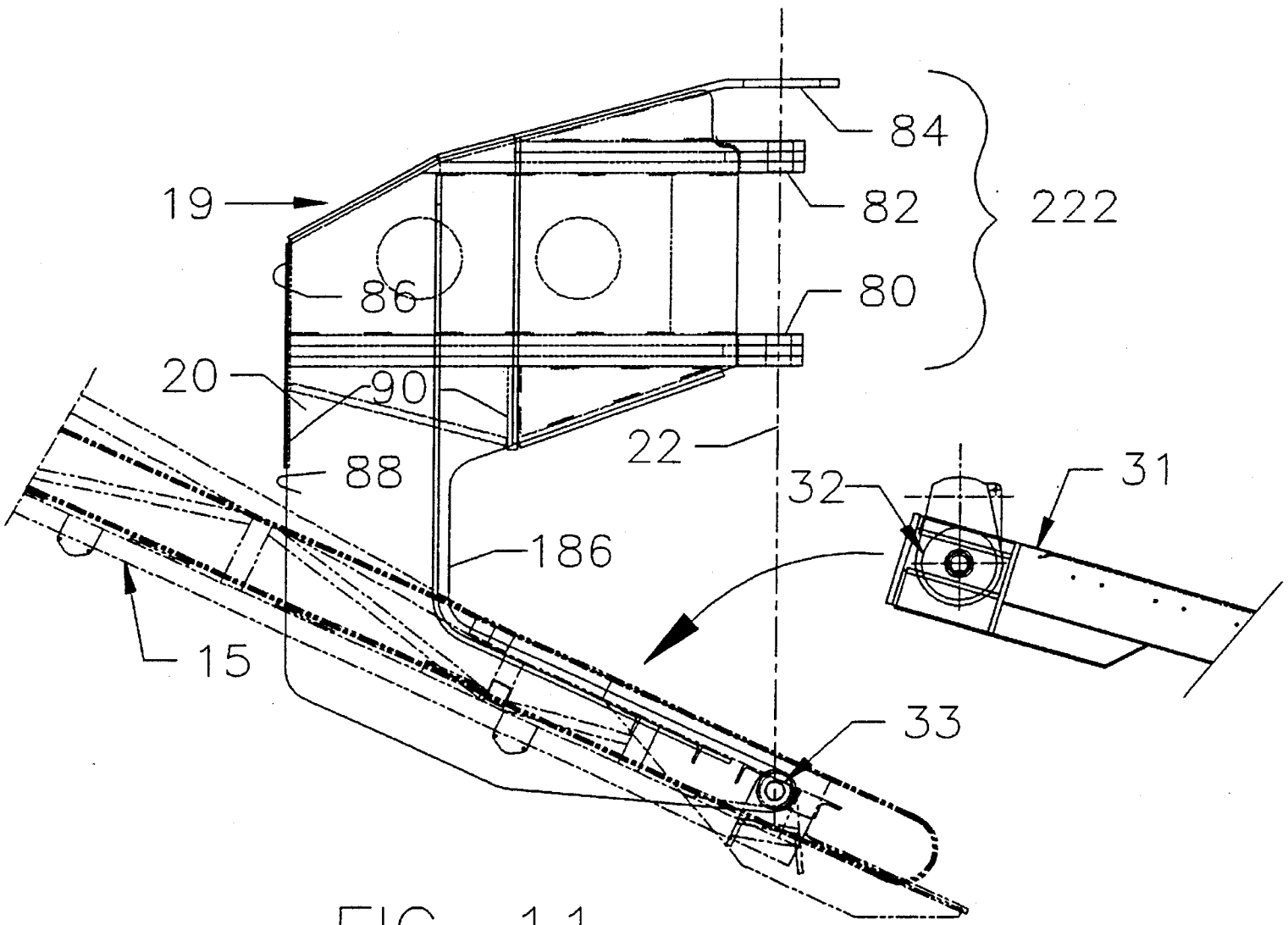
FIG. 11 is an isolated, enlarged, broken, part diagrammatical, part schematical, part cross-sectional side view of part of the apparatus disclosed in FIGS. 1 and 5; and, FIG. 12 is a front view of the apparatus of FIGS. 10 and 11.
Figure 12:
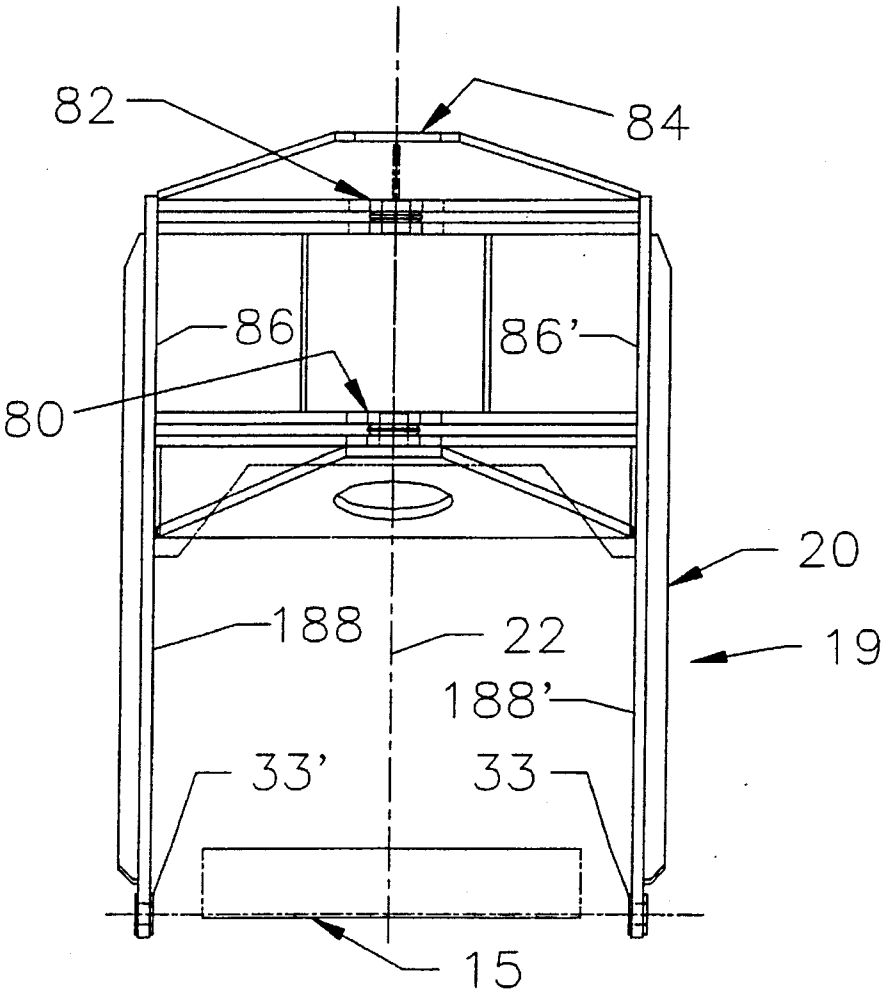

In FIGS. 1 and 2, together with FIGS. 6–9 of the drawings, a forward pair of spaced apart track assemblies 24 and 25, respectively, located on the left and right, respectively, of the ground supported mining machine 10 are spaced forwardly of a rearwardly located left and right track assembly 26 and 27, respectively, leaving a mid-section 11 therebetween. Each of the track assemblies 24, 25, 26, 27 is supported from an extensible telescoping strut assembly (40, 40', 52, 52') which, as seen in FIGS. 6, 8 and 9, is reciprocatingly arranged respective to each of the quadrants of the mining machine and is independently extensible with respect thereto. The forward and rear track assemblies 24, 25 and 26, 27, respectively, are mounted as shown in FIGS. 1 and 2 and maintain a mining drum 128 of a digging apparatus 28 in properly aligned relationship respective to the ground, as shown, to facilitate excavation of material.

As best seen illustrated in FIGS. 1–6, the mining drum 128 of the digging apparatus 28 preferably includes several axially aligned toothed members that are rotatably supported respective to a large main mounting shaft 28' that provides opposed shaft ends. The main shaft 28' is firmly anchored respective to the main frame and thereby imparts a minimum of vibratory forces into the attachments thereof. The main shaft 28' is arranged as shown for rotatably receiving the three illustrated, axially aligned members of the mining drum 128 thereon. The opposed marginal shaft ends facilitate extension of the opposed marginal ends of the mining drum beyond the opposed sides of the mining machine 10, thereby mining a swath or path that is wider than the mining machine 10, whereby the mining machine 10 can travel unobstructed along the path cut by the mining drum 128. Hence the path cut by the mining drum can be adjacent a cliff or other structure, leaving no stair-stepped embankment, as may be desired.

The shaft can be stationary or rotatably anchored to the main frame, and it is intended that both these expedients are deemed to fall within the comprehension of the term "anchored respective to the main frame"; i.e.; a rotating shaft can be journaled to and firmly anchored to a main frame member so that the relative position therebetween is fixed. It has been discovered that a main shaft mounted for movement respective to the main frame has resonate frequencies induced into the coacting members thereof and thereby induce distructive resonate forces in the members thereof and accordingly greatly reduce the life expectancy of the various members and especially the digging teeth thereof. Hence in this invention the mining drum main shaft is firmly anchored to the main frame in a manner that the mining drum is rotatably received respective to the axis of the mining drum main shaft and thereby reduces vibrations associated with resonate frequencies.

A mount assembly 29 supports the shaft 28' directly from the main frame members, as seen in FIGS. 1, 2, and 6, and is located within the interior of the centrally located ladder type digging apparatus 228. Preferably the mount assembly 29 supports the shaft 28' at spaced locations and is positioned as shown in FIG. 6 along a line that extends between the shafts 28' and 150. This arrangement provides a rigid, non-oscillating or immovable support by which the mining drum shaft 28' is fixed respective the main frame and positioned at the center of gravity of the quarry miner and thereby achieves an optimum digging or operating position while inducing minimum vibrational loads into the members thereof. This construction makes possible for the ground engaging exterior of the mining drum to have a continious and uninterrupted array or pattern of digging teeth.

A mold board 30 is arranged laterally of the quarry miner and in spaced, parallel relationship respective to the longitudinal axis of the mining drum of the digging apparatus 28. The front face of the mold board 30 slopes upwardly and rearwardly and is provided with an elevator by which it is vertically adjusted respective to the main frame member of the quarry miner 10 and the prepared ground surface 14, and thereby assures that material removed by the rotating mining drum 128 is properly accumulated and subsequently discharged onto the feed end of an internal, centrally located conveyor system illustrated by the numeral 31 (see FIGS. 1, 2 and 6). Hence the rotating action of the mining drum 128 forces the excavated material to move up the intervening space formed between the central part of the mining drum and the mold board.

The feed end of the internal centrally located conveyor 31 preferably is fixed respective to the main frame and therefore is slidably connected respective to the illustrated bulkheads of the mold board 30. Conveyor 31 is therefore always properly positioned to receive the excavated material that is removed by the rotating mining drum 128 and overflows the mold board.

Those skilled in this art, having digested this disclosure, should now comprehend how to arrange a coextensive scrapper blade at the lower end of the mold board to trim the cut surface 12 smooth. The present invention also provides for proper spacing between the confronting face 130 of the mold board 30 and the outer inclined upwardly moving surface of the mining drum 128 to form a passageway between the outer rotating surface of the mining drum 128 and the adjacent confronting surface 130 of the mold board 30. Thus the mining drum has a surface that forces the accumulated excavated material centrally of the mold board 30, which in turn is arranged respective to the mining drum to force the accumulated excavated material up between the rotating mining drum 128 and the confronting sidewall or face of the mold board 30 where the excavated material is discharged onto the feed end of the internal centrally located conveyor system 31.

In this instance, it will be noted that the mold board 30 extends parallel respective to and closely adjacent the upwardly moving digging surface of the digging apparatus. The illustrated commercially available digging teeth 129 of FIG. 2, which can take on a number of different forms, preferably are arranged respective to the moving surfaces associated with the digging apparatus 28 to force excavated material towards the center of the mold board, as suggested by the converging lines seen in FIG. 2. This unique orientation of the moving digging teeth, together with the position of the mold board relative to the digging apparatus 28, and the dynamic action of the digging apparatus 28 to which the teeth 129 are mounted, cooperate together in an unexpected and desirable manner to force the excavated material to move up the intervening space formed between the mold board and the digging apparatus 28, whereupon the excavated material is moved towards the upper central part of the mold board 30 where it spills over onto the feed end of the inner conveyor system 31. Accordingly, the inner conveyor has an effective width approximately equal to the width of the center section of the mining drum.

In FIG. 6, numeral 131 indicates some of the details by which the feed end of the conveyor is supported for movement respective the mold board 30, noting there is a journal means 131 received for movement within the elongated slot 233 formed in the illustrated spaced bulkheads of the mold board 30.

The discharge end 32 of the internal conveyor system 31 overhangs the feed end 33 of the pivoted boom conveyor system 15. Accordingly, the digging apparatus 28 excavates material from the surface 12, and conveys the material through the interior of the quarry miner 10 by means of the internal centrally located conveyor 31. The excavated material is discharged onto the feed end 33 of the pivoted boom conveyor system 15. Note that the discharge end 32 of the internal conveyor system 31 and feed end 33 of the boom conveyor are located directly below hinge centerline 22 of the boom conveyor 15 and the pylon assembly 16 to thereby maintain proper alignment therebetween, and to assure proper transfer of material therebetween, for all positions of operation.

The pivoted boom conveyor system 15 discharges the excavated material from the far or discharge end 34 thereof, whereupon the mining operation of the quarry miner 10 is concluded by filling trucks with the discharged material, or by stock piling the material, or by returning the material onto the mined out area.

A control cab 35 is situated atop the quarry miner machine 10 at a high elevation that allows an operator to visually monitor the operation during the excavation process.

Looking now to FIGS. 1, 2 and 6, an engine compartment 36 houses the power means for the quarry miner, which includes relative small and large internal combustion diesel engines 37 and 38, respectively, along with the associate pumps, transmissions, and other motor driven apparatus necessary for the operation of the quarry miner 10. In FIG. 6, the laterally spaced apart track elevator apparatus 40, 40', respectively, are mounted in the right and left hand quadrant of the forward section of the quarry miner, and include a hydraulically extensible, vertically disposed, support 41 that is telescopingly received for slidable movement within the illustrated axially spaced fixed guide means 42 and 43. The guide means can be in the form of the illustrated square bushings that adequately resist the imposed side loads imparted into the vehicle. The elevator apparatus 40 for the track 24, for example, transfers a selected portion of the load of the quarry miner onto the track assembly 24 by means of the illustrated attachment pins seen at the upper and lower yokes 44 and 45 located at opposed ends of the vertically disposed, square in cross-section, reciprocating support 40.

Accordingly, the forward left and right track assemblies, 24 and 25, each carry a selected or proportionate share of the load presented by the quarry miner. This novel sub-combination precisely positions the mining drum 128 respective to the excavated surface or cut 14, as well as controlling the load imposed on the teeth 129 of the mining drum 128. That is, a selected portion of the load is not supported by track elevator apparatus 40, for example, and therefore is transferred onto the mining drum 128. Hence the mining drum 128 is positioned at the center of gravity of the quarry miner so that any desired load, up to the entire weight of the quarry miner, can be imposed on the digging apparatus by simultaneously retracting all four of the endless track assemblies. Optimum rate of penetration is realized when full power is applied to the power train while at the same time all four of the endless track assemblies are retracted except as required for the force necessary for purchase of the four crawler tracks against the ground to thereby enable the quarry miner to be advanced at the maximum velocity permitted under these conditions of maximum performance.

The arrow at numeral 46 of FIG. 6 broadly indicates a split drive train by which the centrally located relatively large engine 38 is connected to power the centrally located mining drum 128 of the digging apparatus 28. The direct connection of the engine 38 to the drive train and thence to the digging apparatus allows the engine 38 therefor to be completely devoted to the rotation of the mining drum so that power surges and other distractions that occur due to the changes in power consumption of the other power consuming devices do not change the output to the mining drum. Various known electronic and mechanical monitoring and control devices can advantageous be utilized in obtaining optimum performance from the system, as may be desired.

The drive train 46 includes a transmission 47' having a propeller shaft P thereof directly connected to a centrally located differential gear box 47 which rotates the illustrated opposed output shafts to which there is mounted spaced apart right and left sprockets 48 and 48'. Sprockets 48, 48' are connected by endless chains to right and left rotatable relatively large sprockets, 49 and 49'. Right and left lower rotatable sprockets 50, 50' are connected by an endless chain to be driven by the before mentioned relatively small sprockets at 49 and 49'. The right and left lower rotatable sprockets 50, 50' are connected to an upper shaft assembly 150 that drives the endless, centrally located, ladder type, digging apparatus 228 that is supported for movement between main anchored shaft 28' and power shaft 150 for rotating the mining drum 128, as seen illustrated in FIGS. 2 and 6.

It should be noted that the entire structure 250 to which the shafts of sprockets 50, 50' and 49, 49' are mounted can be slidably moved vertically, thereby tightening the chains of the ladder type, digging apparatus 228 , noting that the main shaft 28' is anchored in fixed relationship respective to the main frame.

As illustrated in FIGS. 2 and 6, there are spaced endless chains 228' and 228' near opposed sides of the ladder type digging apparatus 228 that are meshed between the driven sprockets of the mining drum 128 and the drive sprockets of the upper shaft assembly 150. Mounted on the chains 228', 228' are spaced, parallel, lateral members 228" attached thereon for mounting digging teeth 129 thereto that are arranged in the indicated chevron pattern set forth by the converging lines. This arrangement forces the excavated material towards the center of the mold board 30 where it is lifted onto the central conveyor system by the cooperative action of the lower surface of the endless ladder type digging apparatus 228 and the forward face of the mold board. The endless drive chains 228' and 228' are meshed with the spaced apart sprockets 87' and 128 that are located adjacent to sprockets 50, 51' and mounted on the drive shaft seen at 150 and 28'.

The split drive 46 accordingly commences at the motor transmission 47' which drives gear box 47. The gear box 47 rotates opposed lateral shaft ends to which sprockets 48, 48' are attached to drive an endless chain which extends to drive sprockets 87 that are attached to sprockets 49, 49' located adjacent the sidewalls of the engine compartment, so that the propeller shaft P can unobstructedly pass centrally into attachment with and drive the centrally located gear box 47. Endless chain 86 extends down each side of the engine compartment into operative engagement with the before mentioned sprockets 50, 50' located on slidable device 250.

In FIGS. 2 and 6, it can be seen that sprockets 50, 50' are attached to operate the centrally located part of the endless digging apparatus 228 and that the endless digging apparatus in turn rotates the centrally located mining drum 128 of the digging apparatus 28. The endless digging apparatus 228 include a pair of opposed endless chains 228' and 228' that are meshed with the sprockets supported by the mining drum shaft 28'. The sprockets supported on shafts 150 and 28' are therefore attached to drive the ladder type centrally located excavating apparatus that also forms the drive for the entire rotating mining drum 128 of the digging apparatus 28. The opposed ends of the central part of the mining drum 128 are affixed to the cylindrical side diggers as shown in FIGS. 2 and 6 at 128' and 128".

The digging apparatus 28 is therefore comprised of a mining drum that includes three axially aligned cylindrical sections 128, 128', and 128" arranged to rotate about the longitudinal axis of the laterally arranged lower shaft 28'. The mining drum is driven by the before mentioned centrally located ladder type digging apparatus which in turn is driven by sprockets 50, 50'. The spaced apart sprockets 50, 50= rotate in a counter-clockwise direction as viewed from the lefthand side of the machine, as particularly seen illustrated in FIG. 6. This arrangement maintains the digging or ground engaging surface of the centrally located ladder type chain digging apparatus 228 tight on the upwardly moving side that is located nearest adjacent to the mold board 30.

Accordingly, a tight chain and a constant space or passageway is maintained between the mold board 30 and the digging apparatus 28 in accordance with this novel combination.

The opposed rear track elevator apparatus, or telescoping strut assemblies 52 and 52' in FIGS. 1, 2, and 6 are each independently vertically positioned by the illustrated hydraulicly actuated pistons 53 and 54. The pistons 53 and 54 are pinned to the vehicle at load distribution fixture 55, which in turn is affixed to the illustrated superstructure of the quarry miner. The other opposed ends of the pistons 53 and 54 are pinned to the yoke 56, which in turn is pinned to the track assembly at load transfer pin 57. Each strut assembly 52, 52' includes a slide member 59 that is rectangular in cross-sectional configuration and is affixed at yoke 56 to be reciprocatingly received within complementary configured guide member 58 which in turn is attached to the quarry miner superstructure at load transfer pad 73.

Application of hydraulic pressure to the pistons 53, 54 effects relative movement therebetween, and thereby telescopingly adjusts the height of either rear quadrant of the quarry mining machine 10 respective to the ground, which also controls the force imposed on the mining drum 128, in a manner similar to the previous discussion of the strut assemblies of the forward track elevator apparatus 40, 40'. It is preferred that the opposed rear track elevator apparatus 52 and 52' are made non-rotatable. However, it is considered within the comprehension of this invention to make each rear track elevator apparatus 52 and 52' steerable in accordance with the teachings set forth in conjunction with the forward track elevator apparatus or strut assembly 40 and 40'.

FIGS. 6, 7, 8 and 9 further disclose various additional details of a hydraulically actuated steering mechanism 59 which is assembled in conjunction with the forward, axially rotatable, right and left, reciprocating, track strut assembly 40 and 40'. As seen in FIGS. 1, 7 and 8, the assembly includes a pair of hydraulically actuated steering cylinders 60 and 60' each having one end thereof pivotally attached to the quarry miner at pin 61, while the opposed end thereof is attached to rotate a bellcrank 62. The bellcrank 62 is secured to the before described non-reciprocating part of the strut 40, which can be rotated about the vertical axis thereof. The lower end of the strut assembly has a pair of outwardly extending arms, 63 and 64, connected to turn the strut axially in a manner as diagrammatically illustrated in FIGS. 7 and 8.

A steering tie bar assembly 65, best seen in FIG. 7, has opposed tie rod ends 66, 67 thereof affixed to arms 64, 70 of the laterally spaced bellcranks 62, 68. Bellcrank 68 is similarly attached to rotate the reciprocating support strut 40', and includes bellcrank arms 69, 70. Stop pads 71 and 71' are supported on each of the bellcrank arms 63, 64, 70 and 71, and can be positioned other than as illustrated to achieve any desired turning radius.

Figure 4:
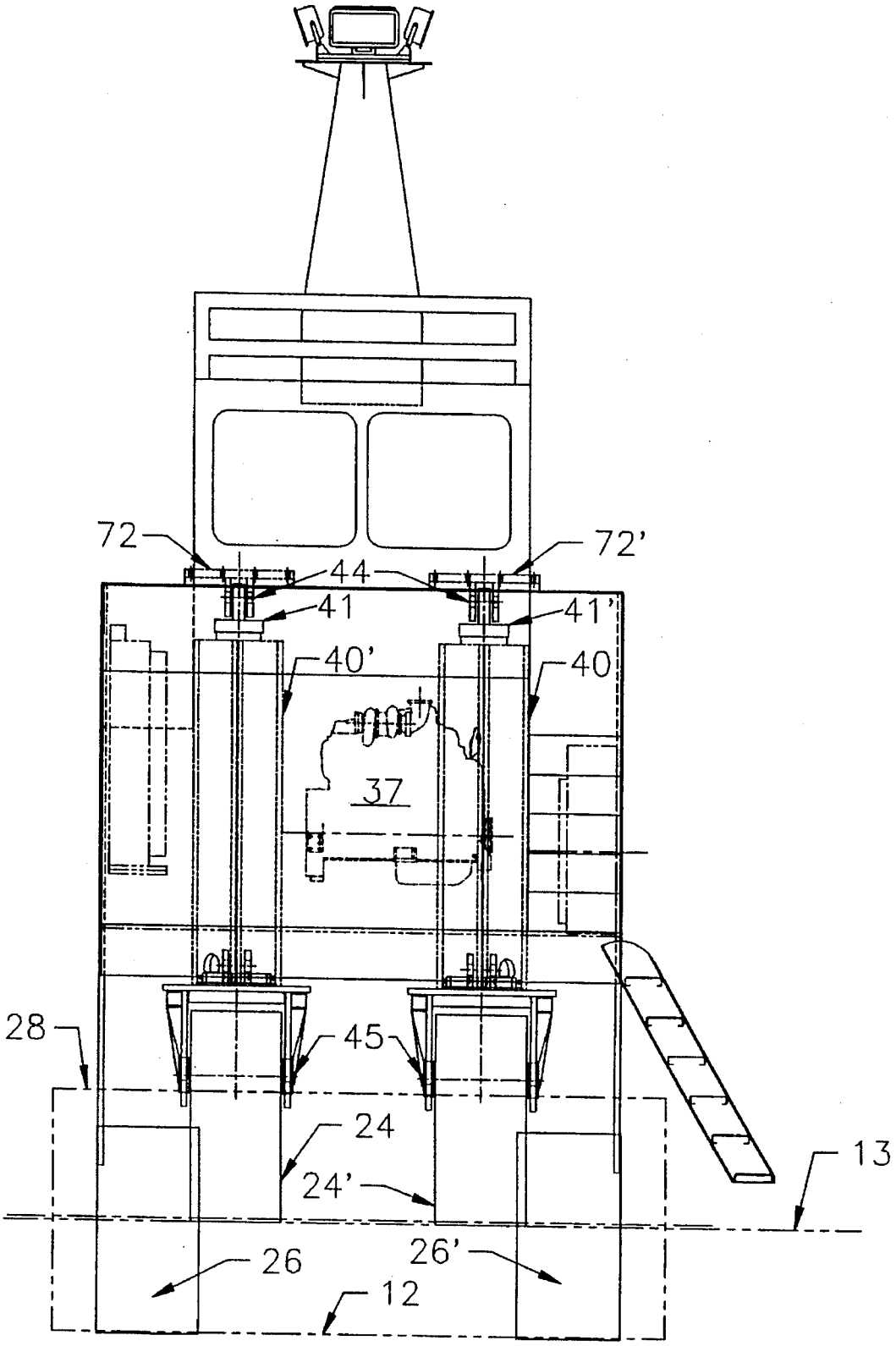
FIG. 4 is an enlarged front view of FIG. 3 showing additional details of the mining machine, with some parts thereof being removed therefrom to illustrate the interior thereof, and some other parts being shown in phantom to illustrate the location thereof.

In FIGS. 2, 4 and 6, four load transfer pads 72, 72', 73, 73'; respectively; are employed to interconnect the four strut assemblies 40, 40', 52, 52'; respectively; to each quadrant of the vehicle structure, as shown, to therefore distribute the resultant force of the load carrying members that are supported on the tracks 24, 25, 26, and 27; respectively.

The forwardly located relatively small engine 37 drives a hydraulic pump for supplying hydraulic fluid to power various hydraulic motors connected to operate boom conveyors 15 and 31, to extend the struts 40, 40', 52, 52', to power the crawler tracks 24, 25, 26 and 27; and, to power the cylinders 60 and 60' of the steering mechanism of FIG. 7. It is preferred that at least one hydraulic motor is employed at each of the track assemblies for individually propelling the track of the quarry miner; and, a separate hydraulic motor is employed for powering the boom mechanism. Further, a separate double acting hydraulic cylinder (not shown) is connected between the pivoted gooseneck conveyor support member 20 and the fixed gooseneck conveyor support member 21 and pivotally moves the boom conveyor respective the main frame.

In FIGS. 1 and 6, the quarry miner can be separated at the attachments found at separation flanges 74 and 75 and thereby reduced or divided into a plurality of loads 76, 77 and 78, for example, that are of a size and weight to be transported along roadways. The sections 76, 77 and 78 are bolted together in a suitable manner to removably secure one to the other in a structurally sound manner.

The digging machine 10 of this invention excavates the ground in a superior manner for the reason that the relative position of the digging surface of ther mining drum is continually adjusted by selecting the elevation of one or more selected quadrants of the main frame, which in turn adjusts the position of the mining drum to engage the ground in a manner to consume the maximum amount of power that can be continuously delivered by the main motor of the digging machine, thereby operating at the most efficient engine speeds. The excavated material accumulates in advance of the mold board 30 and is translocated up into and through the center of the machine at 31 and then to a location 34 that is spaced from the digging machine 10. The mounting of a digging apparatus within the vehicle mid-section in underlying relationship thereto, and at the center of gravity of the quarry miner, provides a means by which any desired weight can be imposed on the digging apparatus. Further, great efficiency is realized by mounting the digging apparatus 28 directly onto a common rotatable shaft 28', which in turn is anchored to the main frame, and, utilizing a split gear train to match the power output to the dynamic action of the digging teeth as they are moved against the ground to excavate material therefrom. Additionally, the position of the resultant surface 13 respective to the horizon is selected with great accuracy in a new, novel, and useful manner by controlling the force with which each individual strut assembly is extended towards the ground.

The novel mounting of the components of the digging apparatus 28 provides a mining drum 128 having a cylindrical digging surface that extends laterally across and beyond the sides of the quarry miner. The digging teeth are mounted to provide an uninterrupted digging surface about the entire ground engaging outer surface of the mining drum. Accordingly the excavated path is formed by the entire width of the mining drum, and is subsequently further smoothed by the action of the mold board as the quarry miner moves across the ground while digging. The novel mounting of the digging apparatus along with the arrangement of the power train enables unexpected results in penetration rates as already pointed out herein; and also permits digging unusually deep cuts for machines of this size and width of cuts.

For example only, in one reduction to practice of the present invention, it has been found that a supercharged motor delivering up to 1,000 H.P. to a mining drum 52.33 inches diameter (61.81 effective digging diameter including digging teeth) and 13.5 feet width, makes it possible for the mining drum to dig to a depth of more that 30 inches while the mining drum rotates within a range of 375 to 940 RPM. The shaft diameter of the mining drum is 20.0 inches and the shaft is 141 inches in length. The width of the centrally located ladder type digging apparatus is 78 inches, while the opposed side digging drums extend therefrom to provide a total width of 13 feet 6 inches.

I claim:

1. A quarry miner comprising:

a vehicle having a ground engaging support by which said vehicle is supported while being propelled along the ground, said vehicle having a longitudinally extending main frame and opposed sides, opposed ends, a top opposed to a bottom, and a mid-section between said opposed ends;

a digging apparatus attached to said vehicle mid-section in underlying relationship thereto, said digging apparatus including a mining drum having opposed sides and having a shaft, said shaft being anchored to said main frame; power means connected to said shaft and disposed between said opposed sides of said vehicle and connected to said mining drum centrally between said opposed sides thereof for rotating said mining drum; said support moves said main frame respective to the ground and thereby moves said mining drum of said digging apparatus into digging contact with the ground;

a conveyor system having a feed end opposed to a discharge end, said feed end of said conveyor system being mounted within said vehicle mid-section at a location to receive excavated material from said digging apparatus, and the discharge end thereof being positioned to deliver excavated material away from said vehicle;

power means for operating the said conveyor system and for propelling said vehicle along the ground.

2. The quarry miner of claim 1 and further including a mold board mounted between the feed end of said conveyor system and said digging apparatus.

3. The quarry miner of claim 1 wherein said mining dram includes three adjacent cylindrical sections arranged along a common axial centerline, one of said sections being a centrally located cylindrical section driven by an endless chain that forms part of a ladder type endless digging apparatus, and having opposed sides to which the remaining cylindrical sections are mounted, to thereby present a digging apparatus that extends perpendicular to the longitudinally arranged main frame, with said centrally located cylindrical section extending laterally of the vehicle main frame, and with the remaining sections extending beyond the sides of the vehicle to thereby enable a path to be excavated that is greater than the width of the vehicle.

4. The quarry miner of claim 1 wherein said ground engaging support means further include a forward pair of spaced apart, right and left endless track assemblies mounted on vertically redprocating, axially rotatable, strut assemblies, and, a hydraulically actuated steering apparatus therefor by which said track assemblies are concurrently rotated in a horizontal plane for steering said quarry miner;

wherein said quarry miner is made up of a plurality of sections that are removably fastened together and to said mid-section and can be dissembled into a plurality of separated sections for transporting the individual sections to another location; said sections being arranged such that the center of gravity of the quarry miner lays within said mid-section, and wherein said digging apparatus is attached to the vehicle mid-section with the shaft of the mining drum being attached at the center of gravity thereof;

wherein a boom conveyor having a feed end arranged to receive excavated material from said conveyor system;

a goose neck at the trailing end of the quarry miner by which the feed end of the boom conveyor is pivotally supported;

and further comprising a pylon at the upper trailing end of the quarry miner, and a tension means connected between the pylon and the boom conveyor for raising and lowering the boom conveyor.

5. The quarry miner of claim 1 and further including a boom extending from one end of said vehicle, a boom pivot, said boom having a pivoted end attached to said boom pivot which is opposed to a far end thereof; a boom conveyor having a discharge end opposed to a feed end, said boom conveyor being mounted on said boom, means elevating the far end of the boom and moving the far end about the boom pivot;

the discharge end of said conveyor system being mounted in overhanging relationship respective to the feed end of said boom conveyor, whereby, excavated material is discharged from said conveyor system onto the feed end of said boom conveyor where the material is discharged at a remote location therefrom.

6. An excavating machine comprising:

a ground supported vehicle having a main frame; opposed sides, a top opposed to a bottom, and a mid-section between opposed ends thereof supported on said main frame; said vehicle having a center of gravity that falls within said mid-section;

a digging apparatus having a mining drum having opposed sides and rotatably mounted for engaging the ground and having digging teeth on a peripheral surface thereof that are moved against the ground to excavate material therefrom; a shaft anchored to said main frame for rotatably supporting said mining drum respective to said vehicle mid-section in underlying relationship thereto; and, support means for elevating and lowering said main frame to move said digging apparatus respective to the ground and into a selected operating position;

power means disposed between said opposed sides of said vehicle and connected to said mining drum centrally between said opposed sides thereof for rotating said mining drum;

a conveyor system having a feed end mounted within said vehicle mid-section and a discharge end positioned to translocate excavated material away from said vehicle mid-section; and power means for propelling said vehicle along the ground, operating said conveyor system, and raising and lowering said main frame respective to the ground.

7. The excavating machine of claim 6 wherein said mining drum includes three adjacent rotatable sections arranged along a common axial centerline that coincides with said shaft, there being a centrally located rotatable section in the form of a ladder type endless digging apparatus that is centrally located within said vehicle mid-section and having opposed ends to which the remaining rotatable sections are mounted to thereby present a digging apparatus that extends perpendicular to the main frame and in spaced relationship respective to said conveyor means, with the rotatable center section of the mining dram extending laterally of the vehicle, and the remaining sections of the mining drum extending beyond the sides of the vehicle to thereby enable a path to be excavated that is greater than the width of the vehicle.

8. The excavating machine of claim 6 and further comprising an elongated boom pivotally connected to and extending from the trailing end of the vehicle, said boom has a pivoted end which is opposed to a far end thereof; a boom conveyor having a discharge end opposed to a feed end, said boom conveyor being mounted along the length of the boom, means elevating the far end of the boom and moving the far end about the boom pivot; means forming a goose neck at the lower trailing end of the excavating machine by which the feed end of the boom conveyor is pivotally supported therefrom;

a pylon at the upper trailing end of the excavating machine, and tension means connected between the pylon and the boom conveyor for raising and lowering the far end of the boom conveyor.

9. The excavating machine of claim 6 and further comprising end sections removably attached to said mid-section by which said excavating machine can be dissembled into a plurality of sections for facilitating transport thereof to another location.

10. The excavating machine of claim 6 and further including a mold board mounted adjacent to said feed end of said conveyor system and wherein said mold board has a forward face, said mining drum includes a center section and opposed sections connected thereto, a ladder type endless digging apparatus forms the exterior of the center section and is meshed between a drive sprocket on an upper shaft and a driven sprocket at said shaft; said mining drum extends perpendicular to the main frame; said opposed sections extend from the center section beyond the sides of the vehicle and have digging teeth thereon that are arranged to dig into the ground and excavate material and further to move the excavated material towards and up the face of the mold board; the mold board being arranged in parallel relationship respective to the mining drum, with the mold board being connected to be moved vertically respective to the main frame to assure that material removed by the rotating mining drum accumulates onto the feed end of said conveyor system where it is transferred away therefrom.

11. A mining machine for excavating the ground and translocating excavated material to a location spaced from the mining machine, said mining machine comprising a ground supported vehicle having a main frame that supports opposed sides, a top opposed to a bottom, a mid-section, and opposed ends; a digging apparatus mounted in underlying relationship respective to the vehicle mid-section;

wherein said digging apparatus includes a mining drum having digging teeth mounted to the exterior thereof, said digging teeth form a continuous peripheral cutting surface of said drum that can be moved against the ground to excavate material therefrom;

a boom conveyor assembly having a discharge end opposed to a feed end, and including a boom pivotally mounted to and extending from one end of the vehicle, with a conveyor being mounted on the boom, means for elevating and pivoting the far end of the boom conveyor system;

an internal conveyor system having a feed end mounted within said mid-section and a discharge end positioned to deliver material onto said boom conveyor system and away from said vehicle; a mold board mounted for vertical movement at a location between the feed end of the internal conveyor system and said mining drum and forms a passageway therebetween, whereby the mold board accumulates excavated material in advance thereof;

said digging apparatus includes an endless drive means for rotating said mining drum while forcing the accumulated excavated material to move up the passageway and onto the internal conveyor system;

power means for propelling said excavating machine, for operating the conveyor system, for operating the digging apparatus, and for raising and lowering said main frame whereby said digging apparatus makes digging contact with the ground; and for propelling the vehicle along the ground.

12. The mining machine of claim 11 and further comprising end sections removably attached to the mid-section of said mining drum by which said mining machine can be dissembled into a plurality of sections to facilitate transport thereof to another location; a pair of endless tracks at said end sections by which the mining machine is supported and moved across the ground; said mining drum being mounted at the center of gravity of said mid-section;

and further comprising strut means for extending each said endless track towards and away from the ground and thereby select the digging plane of the mining drum as well as the weight imposed thereon.

13. The mining machine of claim 12 wherein said mold board has a forward face that extends parallel to the digging apparatus, and a blade at the lower end of the mold board that makes sliding contact with the surface of the ground to accumulate excavated material between the digging apparatus and the mold board which is directed upward and onto the feed end of the internal conveyor system.

14. The mining machine of claim 13 wherein said feed end of the internal conveyor system is supported by said main frame and said mold board is moved vertically while said feed end of the internal conveyor system remains positioned for receiving and moving the excavated material from the digging apparatus to a location remote from the mining machine.

15. The mining machine of claim 14 and further comprising a goose neck at the trailing end of the mining machine by which a feed end of a boom conveyor assembly is pivotally supported therefrom; means for pivoting said gooseneck and thereby pivoting the boom conveyor;

a pylon at the upper trailing end of the mining machine, and tension means connected between the pylon and the boom conveyor for raising and lowering the far end of the boom conveyor assembly.

16. The mining machine of claim 15 and further comprising a forward pair of spaced apart, right and left track assemblies mounted on vertically reciprocating, axially rotatable, strut assemblies; a hydraulically actuated steering apparatus by which the forward track assemblies are rotated in a horizontal plane for steering said mining machine; and a rearward pair of spaced apart, right and left track assemblies mounted on vertically reciprocating strut assemblies.

17. The mining machine of claim 11 wherein said mold board has a wall surface that is arranged spaced from and in confronting relationship respective to the digging apparatus, and thereby forms said upwardly extending passageway along which the excavated material flows;

and further comprising means for mounting the feed end of the internal conveyor system, the mold board, and the digging apparatus respective to one another to force excavated material to travel up the passageway and overflow the mold board onto the feed end of the internal conveyor system, and means selectively positioning the mold board respective to the main frame; whereby, excavated material is translocated onto the internal conveyor system and is delivered onto the feed end of the boom conveyor assembly which in turn discharges the excavated material at a location remote from the mining machine.

18. The mining machine of claim 11 wherein said digging apparatus includes a mining drum having three adjacent cylindrical sections arranged along a common axial centerline, one of said cylindrical sections being a centrally located section in the form of a ladder type endless digging apparatus that is centrally located within said mid-section and having opposed ends to which the remaining sections are mounted to thereby present a digging apparatus that extends perpendicular to the internal conveyor system, with the center section extending laterally of the vehicle to thereby enable a path to be excavated that is greater than the width of the vehicle;

wherein said mold board has a longitudinally extending face arranged in parallel relationship respective to the central axis of the mining drum to provide a passageway and thereby enable accumulated excavated material removed by the mining drum to move upwards and onto the feed end of the internal conveyor system;

and further comprising means for moving said mold board vertically with respect to the feed end of the internal conveyor system, whereby the mold board can be vertically adjusted respective to the main frame.

* * * * *